United States Patent [19]

Koeleman et al.

[11] Patent Number: 4,503,960

[45] Date of Patent: Mar. 12, 1985

[54] METHOD AND APPARATUS FOR SENSING A SUPPLY OF SHEETS IN A MAGAZINE

[75] Inventors: Gerardus A. J. Koeleman, Velden; Franciscus A. A. E. van de Laarschot, Geldrop, both of Netherlands

[73] Assignee: Océ-Nederland B.V., Venlo, Netherlands

[21] Appl. No.: 409,562

[22] Filed: Aug. 19, 1982

[30] Foreign Application Priority Data

Aug. 27, 1981 [NL] Netherlands ..... 8103975

[51] Int. Cl.[3] ..... B65H 7/02

[52] U.S. Cl. ..... 192/127; 271/263; 355/14 SH

[58] Field of Search ..... 192/125 A, 127; 271/152, 153, 154, 155, 262, 263; 340/615, 674; 355/14 SH

[56] References Cited

U.S. PATENT DOCUMENTS 3,856,125 12/1974 Post ..... 192/127

4,210,319 7/1980 Hynes ..... 271/3.1

4,411,515 10/1983 Kukucka et al. ..... 355/14 SH

FOREIGN PATENT DOCUMENTS 113162 4/1979 Japan ..... 271/154

*Primary Examiner*—Rodney H. Bonck

*Attorney, Agent, or Firm*—Albert C. Johnston

[57] ABSTRACT

A sensor senses the height of a stack of sheets in a magazine. The sensed height is scaled according to the thickness of individual sheets to determine the number of sheets available. At the start of a run of, for example, a copying machine, the number of sheets available is compared to the number of sheets required to complete the run and, if the number available is insufficient, an indication of this fact is given to the operator and an inhibit device may prevent operation of the copying machine. In one embodiment, a counter causes a sampling circuit to determine and display the number of sheets available at predetermined intervals, preferably at the beginning and end of each run.

18 Claims, 2 Drawing Figures

METHOD AND APPARATUS FOR SENSING A SUPPLY OF SHEETS IN A MAGAZINE

Figure 1:
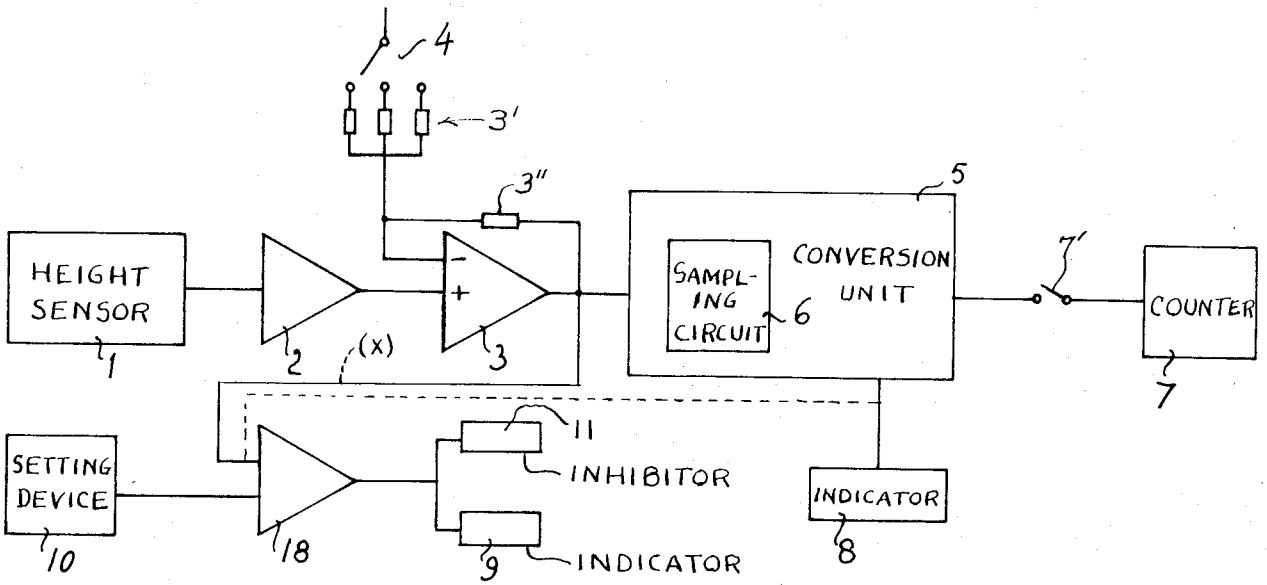

This invention relates to a method and apparatus for sensing a number of sheets of a receiving material such as paper in a magazine and for controlling a copying machine in response thereto.

It is inconvenient to stop a copying machine during a run to add paper. To avoid this, operators frequently begin with more paper in the magazine than the maximum likely to be needed for a run. In a moderate run length of, for example, 99 copies, this tactic works reasonably well. It becomes more difficult to estimate the required paper supply when longer copying runs, such as, for example, 999 copies are required. Such long copying runs thus may require interruption to refill the magazine if the operator estimates incorrectly.

U.S. Pat. No. 4,210,319 describes a copying machine which counts sheets as they pass through the copying process and produces control signals for the copying machine in response to the count.

The principal object of the present invention is to provide a method and apparatus for sensing a supply of sheets in a magazine, and for providing indications and control signals related to the sensed supply.

According to the invention, the number of sheets in the magazine of an associated device such as, for example, a copying machine, is determined from the height of the pile of sheets in the magazine at the beginning of a run. The number of sheets thus determined is compared with the number of sheets to be printed during the run, and a signal is generated indicating which of the two numbers is the larger. If the run length is greater than the number of sheets available, an indication may be given to the operator such as, for example, "add paper". Alternatively, or in addition, the number of sheets remaining in the magazine may be displayed. This latter display is preferably performed based on a sample of the sensed number of sheets taken at the beginning and/or end of a run. Also, operation of the copying machine may be inhibited when there are insufficient sheets to complete the copying run.

The operator may be given means to override the inhibition of the copying machine. The run can thus be started with the foreknowledge that an insufficient stock of sheets is available to complete the run, and can be continued until the magazine is empty.

A detection device derives a first signal which is representative of the number of sheets present in the magazine. The detection device includes a height sensor for sensing the height of the sheets in the magazine and an apparatus for applying a conversion factor to the sensed height to account for the thickness of the sheets. A selector switch may be employed to select the conversion factor. Alternatively, the height change resulting from removal of a predetermined number of sheets from the magazine may be used to calculate the conversion factor. A second signal is derived from a control setting which indicates the run length. A control device compares the first and second signals and, if the desired run length exceeds the number of sheets present, the control device generates a third signal which can be employed as previously indicated for producing an indication or inhibiting operation.

The control device may include a sampling circuit controlled to produce the first signal and/or the conversion factor at times determined by the counts of a counter at the beginning and end of a copying run or of a certain portion or a run.

According to an aspect of the present invention, there is provided a method for sensing a quantity of sheets and for producing at least one signal in response thereto, comprising sensing a height of a stack of the sheets, determining a number of sheets in the stack from the height, comparing the number of sheets with a run length, and producing at least one signal in response to the result of the comparison.

According to a feature of the present invention, there is provided an apparatus for use in a device of the type employing a supply of sheets in a stack and operable in a run requiring a number of sheets, comprising means for measuring a height of the stack to produce a height signal, scaling means responsive to the height signal for producing a first signal proportional to a number of sheets in the stack, means for producing a second signal responsive to a number of the sheets required in the run, and a comparator effective to compare the first and second signals and to produce a third signal in response to the comparison.

The above-mentioned and other objects, features and advantages of the invention will be further evident from the following detailed description and the accompanying drawings of an illustrative embodiment of the invention.

Figure 2:
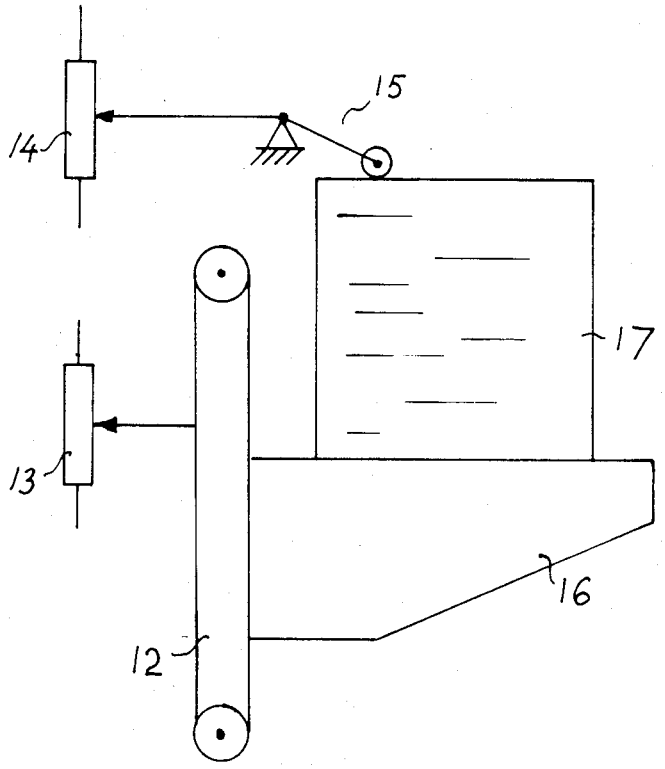

In the drawings:

FIG. 1 is a block diagram of a control device according to an embodiment of the invention; and FIG. 2 is a schematic view of a supporting surface, lifting mechanism and detection device used in an embodiment of the invention.

The control device of FIG. 1 comprises a detection device or height sensor 1 which feeds a signal related to the height of a stack of sheets in a magazine (e.g., FIG. 2) to inputs of a buffer amplifier 2. A control or setting device 10 provides a signal to an input of a differential amplifier 18 indicating the number of sheets to be printed in a run. The output of the buffer amplifier 2 is applied to an input of an operational amplfier 3. A selector switch 4 selects one of three calibration elements 3' for application to a second input of the operational amplifier 3. A feedback element 3'' is connected between an output and the last-mentioned input of the operational amplifier 3. As is well known, the gain of an operational amplifier can be controlled by the ratio of values of its input and feedback elements. Thus, if the calibration elements 3' and the feedback element 3'' are resistors, the gain of the operational amplifier 3 is established by the resistance value of the one of the calibration elements 3' selected by the selector switch 4. The gain of operational amplifier 3 is $1+(3''/3')$.

The selection of a calibration element 3' thus applies a conversion factor to the height signal. The conversion factor may account for the thickness of the sheets and the output of the operational amplifier 3 is thereby calibrated so that it is related to the number of sheets. The output of the operational amplifier 3 is applied to an input of a conversion unit 5 and to an input of the comparator 18.

The conversion unit 5 contains a sampling circuit 6. A counter 7, effective to count the number of sheets used during a run, provides a signal through a switch 7' to the conversion unit 5. The conversion unit 5 provides a signal to an indicator 8 for indicating the actual number of sheets in the magazine at a particular time.

The output of the differential amplifier 18 is applied in parallel to inputs of an indicator 9 and an inhibiting device 11. The inhibiting device 11 is effective in a conventional way to inhibit the operation of an associated copying machine in response to a predetermined condition of its input as will be explained.

In operation, the differential amplifier 18 compares the signal from the operational amplifier 3 with the signal from the setting device 10 to determine whether the number of sheets of paper in the magazine is greater than, or less than the length of run desired. If the number of sheets to be printed in the run is greater than the number of sheets available, the differential amplifier 18 feeds a signal indicating this condition to the indicator 9 and the inhibiting device 11. The indicator 9 may provide an alarm or may display a legend to the operator such as, for example, "add paper" to inform the operator that the run cannot be completed with the paper available. If the number of sheets required to complete the run exceeds the number of sheets available, the inhibiting device 11 may inhibit operation of the copying machine. Optionally, inhibiting device 11 may include an override control (not shown) which the operator may employ to enable the start of a run with the knowledge that an additional supply of sheets must be added before the run can be completed.

Counter 7 may be associated with the conventional feed mechanism of the copying machine to count the number of sheets removed from the magazine. Counter 7 may continuously feed its output to the sampling circuit 6 in conversion unit 5 or, alternatively, it may feed a count at discrete times such as, for example, every ten sheets but preferably, at the beginning and end of each run. For example, the switch 7' may be associated with the conventional start button on the copying machine to enable sampling circuit 6 to produce an indication on indicator 8 of the number of sheets remaining at the beginning and/or end of each run.

In a second embodiment of the invention, calibration for sheet thickness is performed in the conversion unit 5 rather than in the operational amplifier 3. In this embodiment, the operational amplifier 3 is either eliminated or its gain is made constant by employing a fixed resistance in place of the selector switch 4 and the calibration elements 3'. Thus, the input to the conversion circuit is proportional to the height of the stack of paper in the magazine. In such as case, instead of connecting the output of the operational amplifier 3 to an input of the comparator 18, that connection is omitted or broken as indicated by a dashed line (x), and the second input to the comparator 18 is provided from the conversion unit 5 as shown by a dashed line.

In this second embodiment, the sampling circuit 6 is enabled by the counter 7 by the switch 7' to determine the height difference produced by the removal of a predetermined number of sheets from the magazine, during a discrete interval, such as, for example, each time ten sheets are fed or, preferably, from the beginning to the end of each copying run. This height difference as established by the sampling circuit 6 is divided in the conversion unit 5 by the related number of sheets removed as determined by counts of the counter 7, thus producing a conversion factor representative of sheet thickness, expressed for example as a voltage, which in the conversion circuit is applied to the height signal input to circuit 5. Thus a signal is produced that will directly represent the number of sheets remaining in the stack, which signal can be applied to the indicator 8 as well as to the second input of comparator 18.

Referring now to FIG. 2 a vertically movable table 16 supports a pile 17 of sheets for feeding into the copying machine. A lifting mechanism 12 is conventionally controlled to elevate table 16 until the top of pile 17 reaches a standard height sensed by a sensor made up of a variable resistor 14 and a sensor arm 15. A variable resistor 13 has its movable contact coupled for movement with a belt of lifting mechanism 12. Variable resistor 13 is a part of height sensor 1 (FIG. 1) and produces a voltage at its movable contact proportional to the height of table 16 and, since the top of pile 17 is elevated to a fixed height, the output of variable resistor 13 is, in fact, variable in dependence upon the height of pile 17.

According to another embodiment, the table 16 can be kept at a constant level, as for use in a copier into which sheets are fed from the bottom of the pile 17, and a sensor arm similar to arm 15 will act through the variable resistor 14 (potentiometer) to deliver a voltage representing the height of the paper stack from the resistor 14 into the control circuit.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. Apparatus for use in a device of the type employing a supply of sheets in a stack and operable in a run requiring a number of said sheets, comprising:

means for sensing the height of said stack to produce a height signal;

calibrating means responsive to said height signal for producing a first signal representing a number of sheets in said stack;

means for producing a second signal representing a number of said sheets required in said run; and a comparator effective to compare said first and second signals and to produce a third signal representing the comparison.

2. Apparatus according to a claim 1, further comprising means for inhibiting said device in response to said third signal.

3. Apparatus according to claim 1, wherein said calibrating means includes means for applying a conversion factor to said height signal.

4. Apparatus according to claim 3, wherein said means for applying a conversion factor includes an amplifier, a switch effective to connect a calibration element to said amplifier and said calibration element being effective to control a gain of said amplifier in proportion to a thickness of said sheets.

5. Apparatus according to claim 1, 2, 3 or 4, further comprising means responsive to said first signal for indicating a number of sheets remaining in said stack.

6. Apparatus according to claim 5, further comprising means for enabling said means for indicating a number of sheets at at least one of a beginning and an ending of said run.

7. Apparatus according to claim 1, 2, 3 or 4, wherein said height sensing means includes:

a surface supporting said stack;

means for controlling a height of said surface to a position which places a top of said stack at a substantially fixed predetermined height; and a variable resistor controlled by said height of said surface and effective to produce said height signal in response thereto.

8. Apparatus according to claim 1, 2, 3 or 4, further comprising means for producing an indicating in response to a said third signal.

9. Apparatus according to claim 1 or 2 wherein said calibrating means includes an amplifier and means for controlling a gain of said amplifier in relation to a thickness of said sheets.

10. Apparatus according to claim 9, wherein said means for controlling a gain includes a selector switch and a plurality of calibration elements, said selector switch being effective to connect a selected one of said calibration elements to an input of said amplifier, whereby the gain of said amplifier is controlled to produce said first signal.

11. Apparatus according to claim 1 or 2 wherein said calibrating means includes means for determining a change in said height signal produced by removal of a predetermined number of said sheets from said stack to produce a calibration signal and a conversion unit responsive to said calibration signal to convert said height signal into said first signal.

12. A method for sensing a quantity of sheets and for producing at least one signal in response thereto, comprising:

sensing a height of a stack of said sheets;

determining a number of sheets in said stack from said height;

comparing said number of sheets with a run length; and producing at least one signal is response to the result of the comparison.

13. A method according to claim 12, further comprising inhibiting said run in response to said at least one signal.

14. A method according to claim 12, further comprising providing an indication to an operator in response to said at least one signal.

15. A method according to claim 12, 13 or 14, further comprising indicating said number of sheets in said stack.

16. A method according to claim 15, wherein the step of indicating said number of sheets includes sensing at least one of a beginning and an ending of said run, sampling a number of said sheets at said one of a beginning and an ending, and indicating said number.

17. A method according to claim 13 or 14 wherein the step of determining the number of sheets includes controlling a gain of an amplifier in relation to a thickness of said sheets and feeding a signal proportional to said height to an input of said amplifier whereby an output of said amplifier is proportional to said number of sheets.

18. A method according to claim 13 or 14 wherein the step of determining the number of sheets includes determining the change in said height produced by removal of a predetermined number of said sheets from said stack, producing a conversion factor from said change and applying said conversion factor to said height signal to determine said number of sheets in said stack.

* * * * *